US008300004B2

(12) United States Patent
Yeo et al.

(10) Patent No.: US 8,300,004 B2
(45) Date of Patent: Oct. 30, 2012

(54) DISPLAY APPARATUS AND DRIVING METHOD THEREOF SYNCHRONIZING FREQUENCIES OF A SYNCHRONIZATION SIGNAL AND DIMMING SIGNAL

(75) Inventors: Dong-Hyun Yeo, Goyang-si (KR); Byung-Kil Jeon, Anyang-si (KR); Yong-Bum Kim, Yongin-si (KR); Jang-Hyun Yeo, Seoul (KR)

(73) Assignee: Samsung Electronics Co., Ltd. (KR)

( * ) Notice: Subject to any disclaimer, the term of this patent is extended or adjusted under 35 U.S.C. 154(b) by 408 days.

(21) Appl. No.: 12/473,879

(22) Filed: May 28, 2009

(65) Prior Publication Data

US 2010/0053228 A1 Mar. 4, 2010

(30) Foreign Application Priority Data

Sep. 3, 2008 (KR) ..... 10-2008-0086963

(51) Int. Cl.
*G09G 3/36* (2006.01)

(52) U.S. Cl. ..... 345/102; 345/690

(58) Field of Classification Search ..... 345/102, 345/690; 315/169.1–169.4; 375/215; 327/147
See application file for complete search history.

(56) References Cited

U.S. PATENT DOCUMENTS 7,342,561 B2 * 3/2008 Hiraki et al. ..... 345/87
7,417,616 B2 * 8/2008 Min et al. ..... 345/102
2004/0075635 A1 * 4/2004 Arimoto et al. ..... 345/101
2005/0068268 A1 * 3/2005 Song et al. ..... 345/60
2005/0242756 A1 * 11/2005 Honbo ..... 315/403
2007/0132712 A1 * 6/2007 Song ..... 345/102
2007/0146295 A1 * 6/2007 Yu et al. ..... 345/102
2009/0015179 A1 * 1/2009 Hatano et al. ..... 315/307

FOREIGN PATENT DOCUMENTS

JP 2005-316298 11/2005
KR 10-2006-0104411 10/2006
KR 10-2007-0062016 6/2007
WO WO 2006080219 * 8/2006

* cited by examiner

*Primary Examiner* — Alexander S Beck
*Assistant Examiner* — Charles Zheng
(74) *Attorney, Agent, or Firm* — Cantor Colburn LLP

(57) ABSTRACT

A display apparatus includes; a display panel which displays an image in response to a gate voltage and a data voltage, a panel driver which receives a control signal, and which supplies the gate voltage and the data voltage to the display panel according to the control signal, a backlight which supplies a light to the display panel, an inverter which receives a backlight dimming signal, and which controls a brightness of a light emitted from the backlight according to the backlight dimming signal, and a timing controller which receives a synchronization signal, determines a frame frequency of the display panel according to the synchronization signal, outputs the control signal, and modulates the synchronization signal based on a ratio of a predetermined backlight dimming frequency to the frame frequency, and which outputs the backlight dimming signal according to the modulated synchronization signal.

11 Claims, 3 Drawing Sheets

DISPLAY APPARATUS AND DRIVING METHOD THEREOF SYNCHRONIZING FREQUENCIES OF A SYNCHRONIZATION SIGNAL AND DIMMING SIGNAL

This application claims priority to Korean Patent Application No. 2008-86963, filed on Sep. 3, 2008, and all the benefits accruing therefrom under 35 U.S.C. §119, the contents of which in its entirety are herein incorporated by reference.

BACKGROUND OF THE INVENTION

1. Field of the Invention

The present invention relates to a display apparatus and a driving method thereof. More particularly, the present invention relates to a display apparatus capable of improving a display quality and a method of driving the display apparatus.

2. Description of the Related Art

A typical liquid crystal display ("LCD") receives light from a backlight assembly to display images on an LCD panel since the LCD is a non-light-emissive type display. The typical LCD includes an inverter that receives a direct current ("DC") power source from an external supply and supplies an alternating current ("AC") power source to the backlight assembly, wherein lamps are arranged. In order to control brightness of the backlight assembly, the inverter applies a dimming signal, typically of a pulse width modulation ("PWM") dimming type to the backlight assembly.

The LCD typically receives a synchronization signal. The frequency of the synchronization signal is varied according to an image display method of the LCD. If the frequency of the synchronization signal is not synchronized with the frequency of the dimming signal, image display defects occur on the LCD due to noises within the signals or due to the mismatching of the signals.

BRIEF SUMMARY OF THE INVENTION

An exemplary embodiment of the present invention provides a display apparatus capable of synchronizing a frequency of a synchronization signal with a frequency of a dimming signal.

Another exemplary embodiment of the present invention provides a method of driving the display apparatus.

In an exemplary embodiment of the present invention, a display apparatus includes; a display panel which displays an image in response to a gate voltage and a data voltage, a panel driver which receives a control signal, and which supplies the gate voltage and the data voltage to the display panel according to the control signal, a backlight which supplies a light to the display panel, and an inverter which receives a backlight dimming signal, and which controls a brightness of a light emitted from the backlight according to the backlight dimming signal, and a timing controller which receives a synchronization signal, determines a frame frequency of the display panel according to the synchronization signal, outputs the control signal, and modulates the synchronization signal based on a ratio of a predetermined backlight dimming frequency to the frame frequency, and which outputs the backlight dimming signal according to the modulated synchronization signal.

In one exemplary embodiment, the timing controller includes; a memory which stores the backlight dimming frequency, a comparator which reads out the backlight dimming frequency from the memory and outputs the ratio corresponding to the read-out backlight dimming frequency, and an inverter synchronizer which modulates the synchronization signal based on the ratio to output the backlight dimming signal.

In one exemplary embodiment, the comparator includes first and second look-up tables each of which has at least one column representing a frame frequency and at least one row representing a backlight dimming frequency, and the ratio has a fraction form obtained by dividing the backlight dimming frequency by the frame frequency, the first look-up table stores a denominator value of the ratio and the second look-up table stores a numerator value of the ratio.

In one exemplary embodiment, the backlight dimming signal has a frequency corresponding to a value obtained by multiplying the frame frequency by the ratio.

In another exemplary embodiment of the present invention, a method of driving a display apparatus includes; receiving a reference clock signal and a synchronization signal, detecting a frame frequency of a display panel using the reference clock signal and the synchronization signal, detecting a ratio of a predetermined backlight dimming frequency to the frame frequency, modulating the synchronization signal based on the ratio to generate a backlight dimming signal, applying the backlight dimming signal to a backlight, and driving the backlight using the applied backlight dimming signal.

In another exemplary embodiment the ratio has a fraction form obtained by dividing the backlight dimming frequency by the frame frequency, a denominator value and a numerator value of the ratio are selected from a first look-up table and a second look-up table, respectively, and each of the first and second look-up tables has at least one column representing a frame frequency and a row representing a backlight dimming frequency.

According to the above, although a frequency of the synchronization signal is varied, the backlight dimming frequency of the backlight dimming signal is easily changed using the first and second look-up tables. In addition, the display apparatus synchronizes the synchronization signal with the backlight dimming signal, thereby controlling brightness of the backlight according to images displayed on the display panel.

BRIEF DESCRIPTION OF THE DRAWINGS

The above and other aspects, advantages and features of the present invention will become more readily apparent by describing in further detail exemplary embodiments thereof with reference to the accompanying drawings wherein.

DETAILED DESCRIPTION OF THE INVENTION

Figure 1:
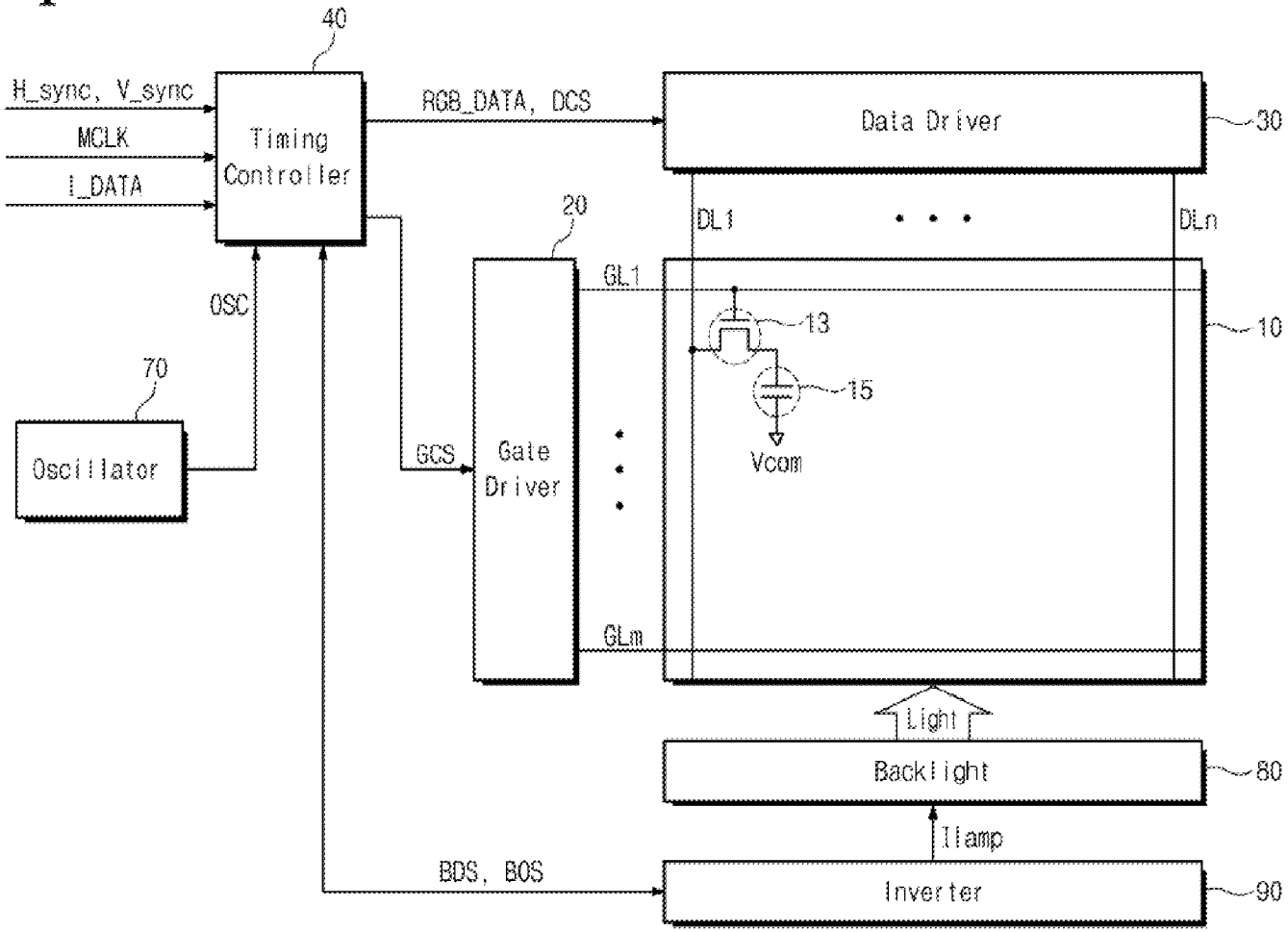
FIG. 1 is a block diagram illustrating an exemplary embodiment of a display apparatus according to the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, the present invention will be described in detail with reference to the accompanying drawings.

FIG. 1 is a block diagram illustrating an exemplary embodiment of a display apparatus according to the present invention.

Referring to FIG. 1, a display apparatus includes a display panel 10, panel drivers 20 and 30, a timing controller 40, an oscillator 70, a backlight assembly 80, and an inverter 90. In one exemplary embodiment the display apparatus may be a liquid crystal display ("LCD") apparatus.

The display panel 10 includes a plurality of gate lines GL1~GLm, a plurality of data lines DL1~DLn crossing the gate lines GL1~GLm to include a plurality of pixel areas, a plurality of thin film transistors ("TFTs") 13 arranged in each of the pixel areas, respectively, and a plurality of liquid crystal capacitors 15 connected to the TFTs 13, respectively. Each of the TFTs 13 includes a gate electrode branching from a corresponding gate line of the gate lines GL1~GLm, a semiconductor layer (not shown) arranged above the gate electrode, an insulating layer (not shown) interposed between the gate electrode and the semiconductor layer, a source electrode branching from the data lines DL1~DLn, and a drain electrode facing the source electrode. The TFTs 13 are used to control a voltage stored in the liquid crystal capacitors 15.

In one exemplary embodiment, the panel drivers 20 and 30 include a gate driver 20 and a data driver 30. The gate driver 20 sequentially applies a scan signal to the gate lines GL1~GLm in response to a gate control signal GCS generated by the timing controller 40. The TFTs 13 connected to the gate lines GL1~GLm, respectively, are turned on in response to the scan signal. The data driver 30 applies a data signal to the data lines DL1~DLn in response to a data control signal DCS from the timing controller 40.

The timing controller 40 receives a horizontal synchronization signal H_sync, a vertical synchronization signal V_sync that determines a frame frequency of the display panel 10, image data I_DATA, a main clock signal MCLK, and a reference clock signal OSC. The timing controller 40 converts the image data I_DATA into image data corresponding to the format of the data driver 30 and provides pixel data RGB_DATA to the data driver 30. The timing controller 40 applies the gate control signal GCS and the data control signal DCS to the gate driver 20 and the data driver 30, respectively, to control the gate and data drivers 20 and 30. In addition, the timing controller 40 modulates the horizontal synchronization signal H_sync and the vertical synchronization signal V_sync based on the reference clock signal OSC, and provides a backlight dimming signal BDS and a backlight operating signal BOS to the inverter 90 based on the horizontal synchronization signal H_sync and the vertical synchronization signal V_sync.

The oscillator 70 generates the reference clock signal OSC and provides the reference clock signal OSC to the timing controller 40.

In the present exemplary embodiment, the backlight assembly 80 is located below the display panel 10 and supplies light to the display panel 10 using a power voltage from an exterior. The backlight assembly 80 may include a plurality of lamps that controls the brightness of the backlight assembly 80 in response to the backlight dimming signal BDS.

The inverter 90 controls a backlight current "Ilamp" supplied to the backlight assembly 80. In one exemplary embodiment, the inverter 90 controls the backlight current Ilamp through a pulse width modulation ("PWM") method according to a brightness control command (not shown) from an exterior, so that the brightness of the backlight assembly 80 may be controlled. In one exemplary embodiment, the inverter 90 may control the backlight current Ilamp using the backlight dimming signal BDS from the timing controller 40.

Figure 2:
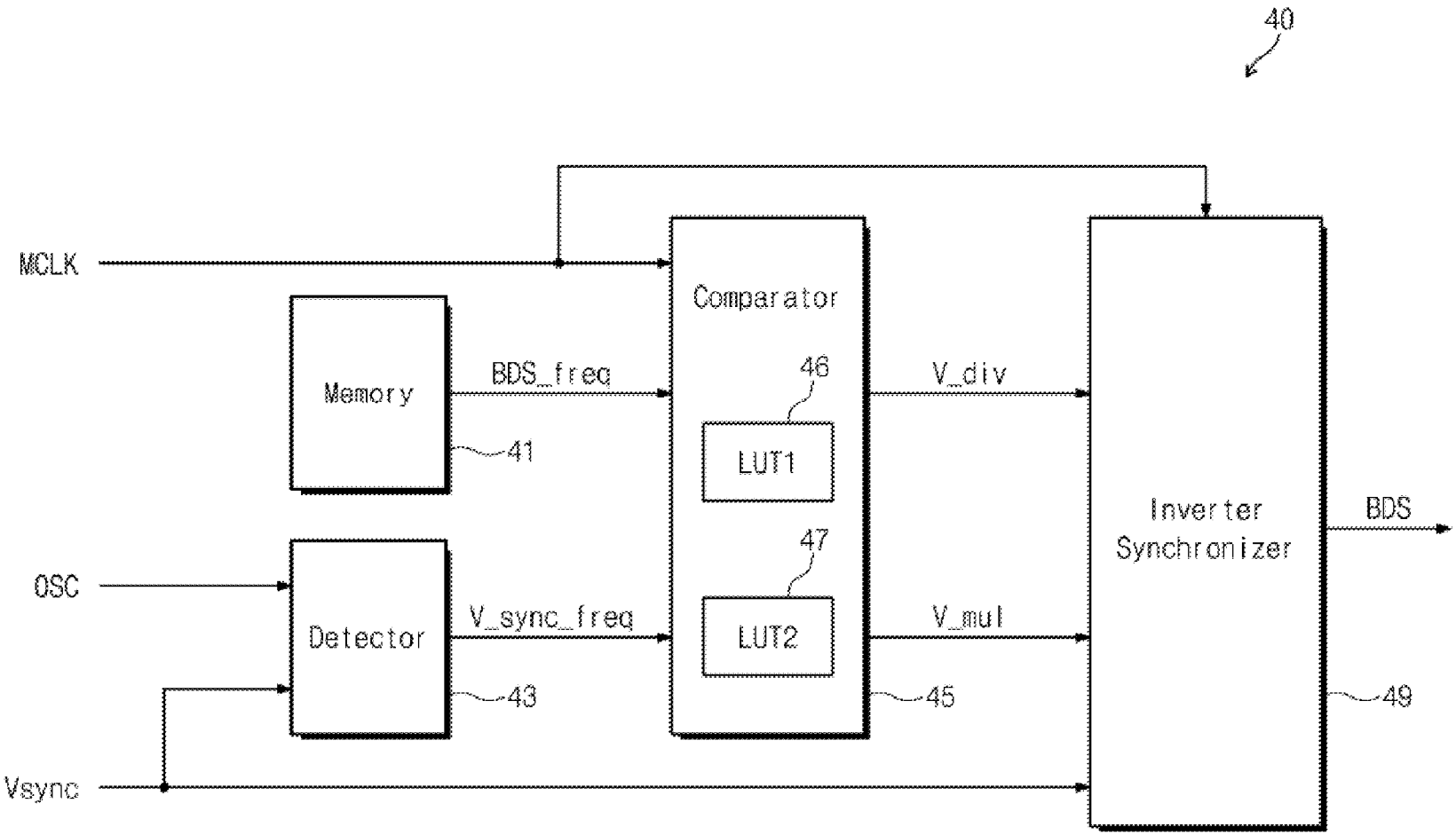
FIG. 2 is a block diagram illustrating an exemplary embodiment of a timing controller of FIG. 1.

Hereinafter, the timing controller 40 will be described in detail with reference to FIG. 2. FIG. 2 is a block diagram illustrating an exemplary embodiment of a timing controller of FIG. 1.

Referring to FIG. 2, in the present exemplary embodiment the timing controller 40 includes a memory 41, a detector 43, a comparator 45, and an inverter synchronizer 49.

In the present exemplary embodiment, the memory 41 is installed inside the timing controller 40 and includes an electrically erasable programmable read-only memory ("EEPROM"). Alternative exemplary embodiments include configurations wherein the memory 41 is disposed outside of the timing controller 40 and wherein it may include other types of memory. The memory 41 stores a frequency of the backlight dimming signal BDS_freq (hereinafter, referred to as backlight dimming signal frequency) applied to the inverter 90 and used to control the brightness of the backlight assembly 80. The memory 41 applies the backlight dimming signal frequency BDS_freq to the comparator 45.

The detector 43 receives the vertical synchronization signal V_sync and the reference clock signal OSC. The detector 43 detects a frequency of the vertical synchronization signal V_sync_freq (hereinafter, referred to as vertical synchronization signal frequency) using the reference clock signal OSC. In detail, the detector 43 counts the vertical synchronization signal V_sync using the reference clock signal OSC, which in one exemplary embodiment may be 1 Hz, to detect the vertical synchronization signal frequency V_sync_freq. The detector 43 provides the vertical synchronization signal frequency V_sync_freq to the comparator 45.

The comparator 45 receives the main clock MCLK, the backlight dimming signal frequency BDS_freq, and the vertical synchronization signal frequency V_sync_freq. The comparator 45 detects a rate of the backlight dimming signal frequency BDS_freq to the vertical synchronization signal frequency V_sync_freq in synchronization with the main clock MCLK and outputs rate values V_div and V_mul to the inverter synchronizer 49. In the exemplary embodiment wherein the rate values are defined by dividing the backlight dimming signal frequency BDS_freq by the vertical synchronization signal frequency V_sync_freq, the comparator 45 includes a first look-up table 46 in which denominator values V_div of the rate values are stored and a second look-up table 47 in which numerator values V_mul are stored.

TABLE 1

| Denominator values (V_div) | | Vertical synchronization signal frequency (Hz) | | | | | | | | | |
|---|---|---|---|---|---|---|---|---|---|---|---|
| | | 20 | 40 | 60 | 80 | 100 | 120 | 140 | 160 | 180 | 200 |
| Backlight Dimming signal frequency (Hz) | 20 | 1 | 2 | 3 | 4 | 5 | 6 | 7 | 8 | 9 | 10 |
| | 40 | 1 | 1 | 3 | 2 | 5 | 3 | 7 | 4 | 9 | 5 |
| | 60 | 1 | 2 | 1 | 4 | 5 | 2 | 7 | 8 | 3 | 10 |
| | 80 | 1 | 1 | 3 | 1 | 5 | 3 | 7 | 2 | 9 | 5 |
| | 100 | 1 | 2 | 3 | 4 | 1 | 6 | 7 | 8 | 9 | 2 |
| | 120 | 1 | 1 | 1 | 2 | 5 | 1 | 7 | 4 | 3 | 5 |
| | 140 | 1 | 2 | 3 | 4 | 5 | 6 | 1 | 8 | 9 | 10 |
| | 160 | 1 | 1 | 3 | 1 | 5 | 3 | 7 | 1 | 9 | 5 |
| | 180 | 1 | 2 | 1 | 4 | 5 | 2 | 7 | 8 | 1 | 10 |
| | 200 | 1 | 1 | 3 | 2 | 1 | 3 | 7 | 4 | 9 | 1 |

TABLE 2

| Numerator values (V_mul) | | Vertical synchronization signal frequency (Hz) | | | | | | | | | |
|---|---|---|---|---|---|---|---|---|---|---|---|
| | | 20 | 40 | 60 | 80 | 100 | 120 | 140 | 160 | 180 | 200 |
| Backlight Dimming signal frequency (Hz) | 20 | 1 | 1 | 1 | 1 | 1 | 1 | 1 | 1 | 1 | 1 |
| | 40 | 2 | 1 | 2 | 1 | 2 | 1 | 2 | 1 | 2 | 1 |
| | 60 | 3 | 3 | 1 | 3 | 3 | 1 | 3 | 3 | 1 | 3 |
| | 80 | 4 | 2 | 4 | 1 | 4 | 2 | 4 | 1 | 4 | 2 |
| | 100 | 5 | 5 | 5 | 5 | 1 | 5 | 5 | 5 | 5 | 1 |
| | 120 | 6 | 3 | 2 | 3 | 6 | 1 | 6 | 3 | 2 | 3 |
| | 140 | 7 | 7 | 7 | 7 | 7 | 7 | 1 | 7 | 7 | 7 |
| | 160 | 8 | 4 | 8 | 2 | 8 | 4 | 8 | 1 | 8 | 4 |
| | 180 | 9 | 9 | 3 | 9 | 9 | 3 | 9 | 9 | 1 | 9 |
| | 200 | 10 | 5 | 10 | 5 | 2 | 5 | 10 | 5 | 10 | 1 |

Table 1 shows the first look-up table 46 in which the denominator values V_div are stored and Table 2 shows the second look-up table 47 in which the numerator values V_mul are stored.

In Tables 1 and 2, the first and second look-up tables 46 and 47 have a size corresponding to a frequency range, e.g., about 0~ to about 200 Hz, of the backlight dimming signal frequency BDS_freq and the vertical synchronization signal frequency V_sync_freq. As shown in Tables 1 and 2, the frequency range of the backlight dimming signal frequency BDS_freq and the vertical synchronization signal frequency V_sync_freq is divided by e.g., 20 Hz, and the denominator value V_div and the numerator value V_mul have a value of 1 to 10. However, alternative exemplary embodiments include configurations wherein the frequency range of the backlight dimming signal frequency BDS_freq and the vertical synchronization signal frequency V_sync_freq may be varied, and the denominator value V_div and the numerator value V_mul may also be varied depending upon the frequency range.

The comparator 45 reads out the denominator value V_div and the numerator value V_mul derived from the first and second look-up tables 46 and 47, respectively, based on the backlight dimming signal frequency BDS_freq and the vertical synchronization signal frequency V_sync_freq. In particular, when the vertical synchronization signal frequency V_sync_freq and the backlight dimming signal frequency BDS_freq are 120 Hz and 160 Hz, respectively, the denominator value V_div is 3 and the numerator value V_mul is 4. The comparator 45 provides the rate values V_div and V_mul based on the denominator value V_div and the numerator V_mul to the inverter synchronizer 49.

The inverter synchronizer 49 receives the main clock signal MCLK, the vertical synchronization signal V_sync, the denominator value V_div, and the numerator value V_mul. The inverter synchronizer 49 modulates the vertical synchronization signal V_sync based on the denominator value V_div and the numerator value V_mul in synchronization with the main clock signal MCLK. The inverter synchronizer 49 modulates the vertical synchronization signal V_sync to generate the backlight dimming signal BDS. In one exemplary embodiment, the vertical synchronization signal V_sync is modulated according to the following equation:

$$Freq(BDS) = Freq(\text{V_sync}) \times \left(\frac{\text{V_mul}}{\text{V_div}}\right) \qquad \text{< Equation 1 >}$$

In Equation 1, Freq(BDS) denotes the frequency of the backlight dimming signal BDS, Freq(V_sync) denotes the frequency of the vertical synchronization signal V_sync, V_mul denotes the numerator value, and the V_div denotes the denominator value.

In one exemplary embodiment, the inverter synchronizer 49 may generate the backlight dimming signal BDS having the frequency of 160 Hz by multiplying the vertical synchronization signal V_sync having the frequency of 120 Hz by 4/3 obtained from the denominator value V_div and the numerator value V_mul. The inverter synchronizer 49 provides the backlight dimming signal BDS to the inverter 90.

As described above, the backlight dimming signal BDS and the vertical synchronization signal V_sync are synchronized with each other, and thus the brightness of the backlight may be effectively controlled according to the images displayed on the display panel. In addition, although the frequency of the vertical synchronization signal V_sync varies, the backlight dimming signal BDS may be generated by modulating the vertical synchronization signal V_sync.

Meanwhile, the horizontal synchronization signal H_sync and the backlight operating signal BOS shown in FIG. 1 may be synchronized with each other by using the timing controller 40 as well as the vertical synchronization signal V_sync and the backlight dimming signal BDS.

Figure 3:
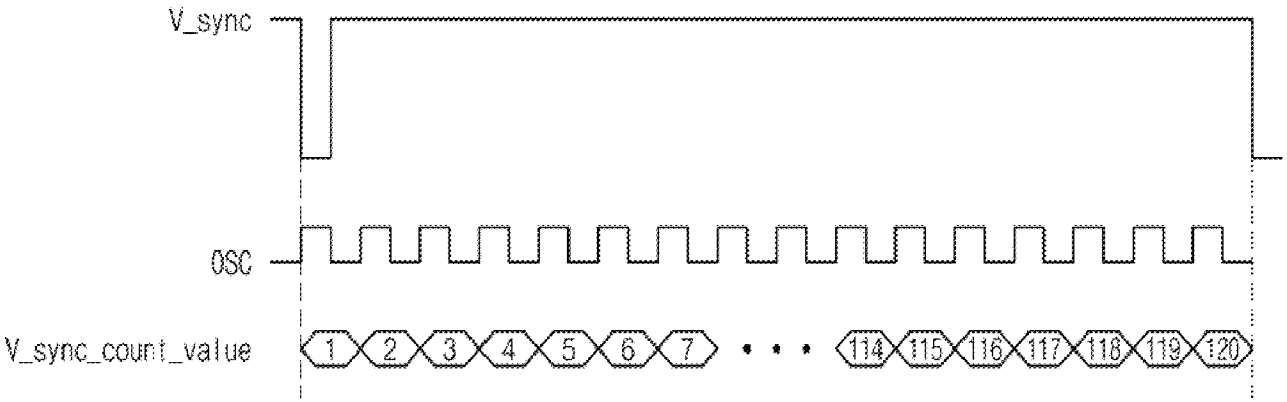
FIGS. 3 and 4 are timing diagrams illustrating operation of the exemplary embodiment of a timing controller of FIG. 2.
Figure 4:
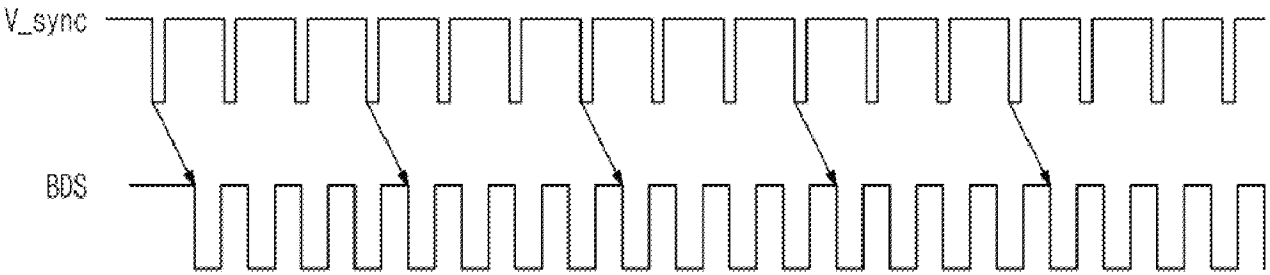

FIGS. 3 and 4 are timing diagrams illustrating an exemplary embodiment of the operation of the exemplary embodiment of a timing controller of FIG. 2.

Referring to FIGS. 3 and 4, when the vertical synchronization signal V_sync including frame information is applied to the timing controller, the timing controller counts the vertical synchronization signal V_sync using a reference clock signal OSC, in one exemplary embodiment the reference clock signal OSC may have a frequency of 1 Hz, to detect the vertical synchronization signal frequency V_sync_freq of 120 Hz. The timing controller reads out the denominator value of 3 from the first look-up table and the numerator value of 4 from the second look-up table based on the backlight dimming signal frequency BDS_freq of 160 Hz and the vertical synchronization signal frequency V_sync_freq of 120 Hz to generate the rate value of 4/3. The timing controller modulates the vertical synchronization signal V_sync using the rate value and generates the backlight dimming signal BDS of 160 Hz.

In the present exemplary embodiment, the timing controller 40 may easily read out the rate value according to the vertical synchronization signal V_sync, thereby easily generating the backlight dimming signal BDS.

According to the above, although the frequency of the vertical synchronization signal is varied, the dimming frequency of the dimming signal is easily changed using the first and second look-up tables. In addition, the display apparatus synchronizes the vertical synchronization signal with the dimming signal, thereby controlling brightness of the backlight according to images displayed on the display panel.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising:

a display panel which displays an image in response to a gate voltage and a data voltage;

a panel driver which receives a control signal, and which supplies the gate voltage and the data voltage to the display panel according to the control signal;

a backlight which supplies a light to the display panel;

an inverter which receives a backlight dimming signal, and which controls a brightness of a light emitted from the backlight according to the backlight dimming signal; and a timing controller which receives a synchronization signal, and which determines a frame frequency of the display panel according to the synchronization signal, outputs the control signal, and modulates the synchronization signal based on a ratio of a predetermined dimming frequency to the frame frequency, and which outputs the backlight dimming signal according to the modulated synchronization signal;

wherein the ratio has a fraction form obtained by dividing the backlight dimming frequency by the frame frequency, wherein the timing controller comprises:

a memory which stores the backlight dimming frequency;

a comparator which reads out the backlight dimming frequency from the memory and outputs the ratio corresponding to the read-out backlight dimming frequency; and an inverter synchronizer which modulates the synchronization signal based on the ratio to output the backlight dimming signal, and wherein the comparator comprises first and second look-up tables each of which has at least one column representing a frame frequency and at least one row representing a backlight dimming frequency, and the first look-up table stores a denominator value of the ratio and the second look-up table stores a numerator value of the ratio.

2. The display apparatus of claim 1, wherein the first and second look-up tables each include:

a plurality of columns, each column representing a different frame frequency; and a plurality of rows, each row representing a different backlight dimming frequency.

3. The display apparatus of claim 1, wherein the dimming signal has a frequency corresponding to a value obtained by multiplying the frame frequency by the ratio.

4. The display apparatus of claim 1, wherein the timing controller further comprises a detector which detects the frame frequency based on a reference clock signal and outputs the frame frequency to the comparator.

5. The display apparatus of claim 4, further comprising an oscillator which generates the reference clock signal.

6. The display apparatus of claim 4, wherein the detector is a counter which determines the frame frequency using the reference clock signal.

7. The display apparatus of claim 1, wherein the backlight comprises a plurality of lamps which emit the light.

8. A method of driving a display apparatus, comprising:

receiving a reference clock signal and a synchronization signal;

detecting a frame frequency of a display panel using the reference clock signal and the synchronization signal;

detecting a ratio of a predetermined backlight dimming frequency to the frame frequency;

modulating the synchronization signal based on the ratio to generate a backlight dimming signal;

applying the backlight dimming signal to a backlight; and driving the backlight using the applied backlight dimming signal, wherein the ratio has a fraction form obtained by dividing the backlight dimming frequency by the frame frequency, and wherein, the ratio has a denominator value and a numerator value selected from a first look-up table and a second look-up table, respectively, and each of the first and second look-up tables has at least one column representing a frame frequency and at least one row representing a backlight dimming frequency.

9. The method of claim 8, wherein the first look-up table stores denominator values of the ratio and the second look-up table stores numerator values of the ratio.

10. The method of claim 8, wherein the first and second look-up tables each include:

a plurality of columns, each column representing a different frame frequency; and a plurality of rows, each row representing a different backlight dimming frequency.

11. The method of claim 8, wherein the backlight dimming signal has a frequency corresponding to a value obtained by multiplying the frame frequency by the ratio.

* * * * *